US008187440B2

(12) United States Patent
Song

(10) Patent No.: US 8,187,440 B2
(45) Date of Patent: May 29, 2012

(54) METHODS OF COATING MAGNESIUM-BASED SUBSTRATES

(75) Inventor: Guangling Song, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 323 days.

(21) Appl. No.: 12/540,641

(22) Filed: Aug. 13, 2009

(65) Prior Publication Data

US 2011/0036723 A1 Feb. 17, 2011

(51) Int. Cl.
*C25D 13/12* (2006.01)

(52) U.S. Cl. ..... 204/500; 204/207; 204/209

(58) Field of Classification Search ..... 204/486–488, 204/500, 507, 509
See application file for complete search history.

(56) References Cited

U.S. PATENT DOCUMENTS

| | | | | |
|---|---|---|---|---|
| 4,419,467 | A * | 12/1983 | Wismer et al. | 523/414 |
| 2004/0137239 | A1* | 7/2004 | Klos et al. | 428/446 |
| 2005/0211275 | A1* | 9/2005 | Wang et al. | 134/37 |
| 2008/0096036 | A1 | 4/2008 | Bharadwaj et al. | |

FOREIGN PATENT DOCUMENTS

CN 1692183 A 11/2005

OTHER PUBLICATIONS

G. Song, A. Atrens, D. Stjohn, J. Nairn, Y. Li, "The Electrochemical Corrosion of Pure Magnesium in 1N NaCl" Journal: Corrosion Science, 1997, pp. 855-875, vol. 39, No. 5.

* cited by examiner

*Primary Examiner* — Kishor Mayekar
(74) *Attorney, Agent, or Firm* — Quinn Law Group, PLLC

(57) ABSTRACT

A method of coating a magnesium-based substrate includes applying a first potential of electric current to the substrate and, after applying, immersing the substrate in an electrocoat coating composition. After immersing, a second potential of electric current is applied between the substrate and a counter electrode to deposit the electrocoat coating composition onto the substrate. The second potential is greater than the first potential. The method also includes curing the electrocoat coating composition to form a cured film and thereby coat the substrate. An electrocoat coating system includes the magnesium-based substrate, and the cured film disposed on the substrate and formed from the electrocoat coating composition. The substrate exhibits a negative charge from an applied first potential of electric current of ≦ approximately 40 V prior to contact with the electrocoat coating composition. The magnesium-based substrate is substantially free from magnesium dissolution when in contact with the electrocoat coating composition.

10 Claims, 1 Drawing Sheet

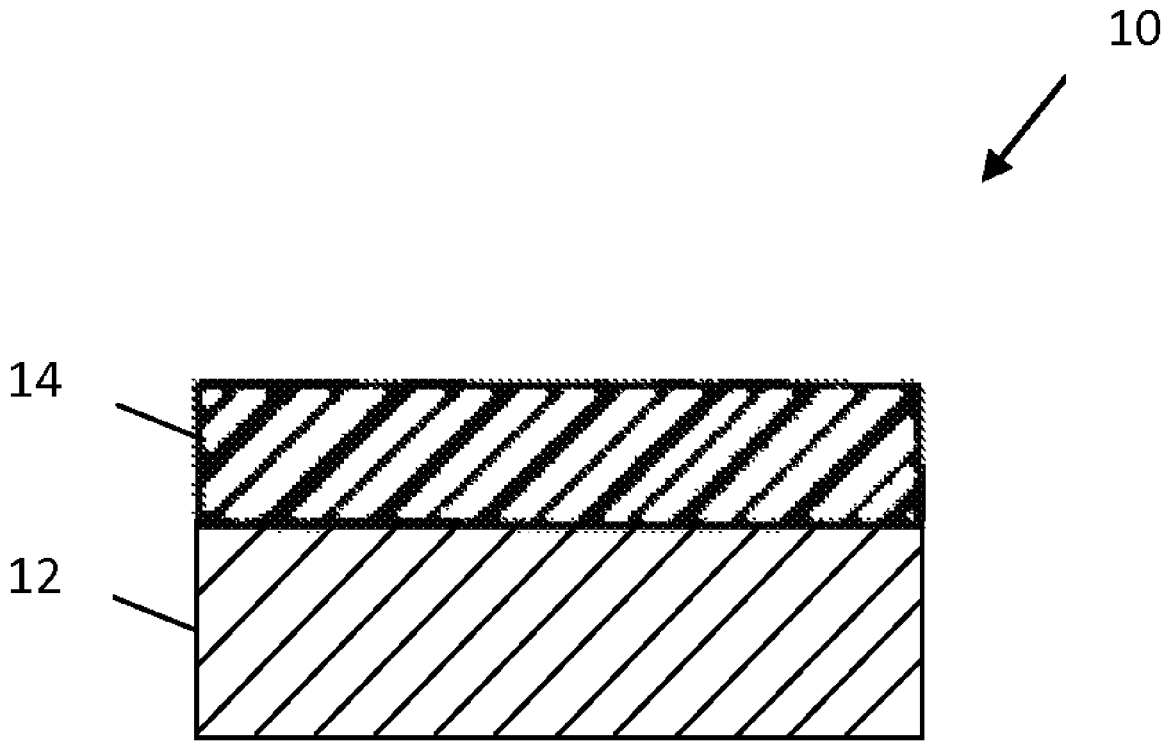
10
14
12

METHODS OF COATING MAGNESIUM-BASED SUBSTRATES

TECHNICAL FIELD

The present invention generally relates to coating a substrate, and more specifically, to electrocoating a magnesium-based substrate.

BACKGROUND OF THE INVENTION

Magnesium and magnesium alloys offer a combination of low specific gravity and excellent strength for applications such as vehicle bodies and components. But, magnesium and magnesium alloys are subject to oxidation and other corrosive reactions in humid environments. Therefore, magnesium-based substrates are often coated with a coating formed from an electrocoat coating composition. Such coatings may be deposited on the substrate via electrodeposition, e.g., electrocoating, to minimize oxidation and corrosive reactions.

Problematically, however, magnesium often dissolves in electrocoat coating compositions, particularly in electrocoat coating compositions having a pH of less than 11. Magnesium-based substrates are particularly at risk for magnesium dissolution during initial immersion in the electrocoat coating composition since the substrate may not yet be cathodic protected. Magnesium dissolution produces corrosion products such as $Mg^{2+}$, $OH^-$, and $H_2$, which further increases the pH of the electrocoat coating composition.

Additionally, magnesium hydroxide, formed from $Mg^{2+}$ and $OH^-$, may settle out of the electrocoat coating composition and render the composition unsuitable for continued electrocoating. Such fouling and necessary replacement of the remaining electrocoat coating composition is costly and time-consuming on an industrial scale.

Finally, corrosion products and magnesium hydroxide may also contribute to a reduced quality of the coating disposed on the substrate, which may in turn accelerate oxidation and other corrosive reactions of the substrate under humid conditions.

SUMMARY OF THE INVENTION

A method of coating a magnesium-based substrate includes applying a first potential of electric current to the magnesium-based substrate and, after applying, immersing the magnesium-based substrate in an electrocoat coating composition. After immersing, a second potential of electric current is applied between the magnesium-based substrate and a counter electrode to deposit the electrocoat coating composition onto the magnesium-based substrate. The second potential of electric current is greater than the first potential of electric current. The method also includes curing the electrocoat coating composition to form a cured film and thereby coat the magnesium-based substrate.

In another embodiment, a method of coating a magnesium-based substrate includes applying a first potential of electric current of approximately 5 V to the magnesium-based substrate and, after applying, immersing the magnesium-based substrate in the electrocoat coating composition. After immersing, a second potential of electric current of from approximately 220 to 240 V is applied between the magnesium-based substrate and the counter electrode to deposit the electrocoat coating composition onto the magnesium-based substrate. The method also includes curing the electrocoat coating composition to form a cured film and thereby coat the magnesium-based substrate.

An electrocoat coating system includes a magnesium-based substrate, and a cured film disposed on the magnesium-based substrate and formed from an electrocoat coating composition. The magnesium-based substrate exhibits a negative charge from an applied first potential of electric current of less than or equal to approximately 40 V prior to contact with the electrocoat coating composition. The magnesium-based substrate is substantially free from magnesium dissolution when in contact with the electrocoat coating composition.

The methods and system of the present invention minimize magnesium dissolution of magnesium-based substrates during electrocoating. Therefore, the methods also minimize fouling and replacement of electrocoat coating compositions during manufacturing. Further, the methods are cost effective and compatible with conventional electrodeposition equipment. Finally, the methods and system provide an excellent cured film on a magnesium-based substrate to protect the substrate from oxidation and other corrosive reactions in humid environments.

The above features and advantages and other features and advantages of the present invention are readily apparent from the following detailed description of the best modes for carrying out the invention when taken in connection with the accompanying drawing.

BRIEF DESCRIPTION OF THE DRAWING

FIG. 1 is a schematic cross-sectional illustration of an electrocoat coating system including a magnesium-based substrate and a cured film disposed on the magnesium-based substrate.

DESCRIPTION OF THE PREFERRED EMBODIMENTS

Methods of coating a magnesium-based substrate and an electrocoat coating system are disclosed herein. The methods and system may be useful for applications requiring protective coatings, such as, but not limited to, vehicle bodies and components. However, it is to be appreciated that the methods and system of the present invention may also be useful for other applications requiring coated substrates, e.g., construction and agricultural equipment, appliances, metal furniture, metal roofing, food-grade containers, electrical switchgear, fasteners, printed circuit boards, wheels, and heating, ventilation, and cooling equipment.

The methods are described with reference to the electrocoat coating system shown generally at 10 in FIG. 1. In particular, a method of coating a magnesium-based substrate 12 includes applying a first potential of electric current to the magnesium-based substrate 12 and, after applying the first potential, immersing the magnesium-based substrate 12 in an electrocoat coating composition.

The magnesium-based substrate 12 may conduct electrical charge and may be formed from any suitable magnesium-based material. For example, the magnesium-based substrate 12 may be formed from a metal. The magnesium-based substrate 12 may be a magnesium alloy, such as, but not limited to, aluminum-magnesium and aluminum-manganese-magnesium. Suitable magnesium alloys may include a microstructure having a primary phase of a solid solution in magnesium and one or more secondary phases including alloying constituents. For example, the secondary phase may include alloying constituents such as aluminum, calcium, strontium, manganese, zinc, and combinations thereof.

The magnesium-based substrate 12 may include at least 1 part by weight magnesium based on 100 parts by weight of the magnesium-based substrate 12. For example, the magnesium-based substrate 12 ordinarily may include up to about 10 parts by weight of the alloying constituents based upon 100 parts by weight of the magnesium-based substrate 12, wherein the balance is magnesium. Suitable examples of magnesium-based substrates 12 include the AM50 magnesium alloy and the AZ91 magnesium alloy.

Prior to immersing the magnesium-based substrate 12 in the electrocoat coating composition, the first potential of electric current may be applied to the magnesium-based substrate 12 via any suitable method. For example, the first potential may be applied directly to the magnesium-based substrate 12 via a transfer element, e.g., a conveyor, an arm, a wire, or an alligator clip, that is attached to a power source. For ease of application, the electric current may be direct.

The first potential of electric current may be selected to minimize magnesium dissolution of the magnesium-based substrate 12 during coating, i.e., during immersion in and deposition by the electrocoat coating composition, as set forth in more detail below. That is, without intending to be limited by theory, it is believed that the applied first potential of electric current controls the dissolution of magnesium in the electrocoat coating composition. The first potential of electric current is applied to the magnesium-based substrate 12 prior to immersing the substrate 12 in the electrocoat coating composition to protect the magnesium-based substrate 12. More specifically, the first potential of electric current protects against magnesium dissolution when the magnesium-based substrate 12 is not yet cathodic- and/or coating-protected.

In one example, the first potential of electric current may be less than or equal to approximately 40 V. In another example, the first potential of electric current may be less than or equal to approximately 10 V. More specifically, the first potential of electric current may be less than or equal to approximately 5 V. At such voltages, e.g., a voltage of less than or equal to approximately 40 V, the magnesium-based substrate 12 is protected during entry into the electrocoat coating composition. Therefore, the first potential may be referred to as an anti-dissolution potential.

It is to be appreciated that the method may also include pretreating the magnesium-based substrate 12 before applying the first potential of electric current. Pretreating may include, for example, precleaning, rinsing, conditioning, and/or sealing the magnesium-based substrate 12. More specifically, the magnesium-based substrate 12 may be cleansed prior to application of a conversion coating to the magnesium-based substrate 12. For example, the magnesium-based substrate 12 may be pretreated with an inorganic phosphate coating, such as zinc or iron phosphate.

In preparation for immersing, the electrocoat coating composition may be provided in a vessel suitably sized for accepting the magnesium-based substrate 12, a sufficient quantity of the electrocoat coating composition, and conveying equipment. For example, the vessel may be a dip-tank configured to immerse a vehicle body-in-white or a component of a vehicle disposed on a conveyor. For transportation applications, the vessel may hold up to approximately 360 $m^3$ of the electrocoat coating composition. The vessel may include a counter electrode that is configured for applying a second potential of electric current, as set forth in more detail below.

The magnesium-based substrate 12 may be immersed in the electrocoat coating composition via any suitable process. For example, the magnesium-based substrate 12 may be conveyed through, dipped into, contacted with, and/or submerged in the electrocoat coating composition. As used herein, the terminology "immersed" refers to at least initial contact with the electrocoat coating composition. The magnesium-based substrate 12 may also be completely immersed in the electrocoat coating composition. Therefore, as set forth above, the magnesium-based substrate 12 is immersed after applying the first potential of electric current.

For transportation applications, the magnesium-based substrate 12 may be conveyed though the electrocoat coating composition so as to provide a sufficient residence time in the vessel to produce a coating of sufficient thickness and corrosion resistance, as set forth in more detail below. For example, the magnesium-based substrate 12 may be immersed in the electrocoat coating composition for a residence time of from about a few seconds to about 3 minutes, more typically from about 1 minute to about 2.5 minutes.

The electrocoat coating composition may be any suitable electrocoat coating composition known in the art. For example, the electrocoat coating composition may be epoxy-based or acrylic-based. Further, the electrocoat coating composition may include urethane, urea, melamine-formaldehyde, phenol-formaldehyde, urea-formaldehyde, and/or acrylamide-formaldehyde crosslinkers. Additionally, the electrocoat coating composition may include polymer solids dispersed in deionized water, and the polymer solids may include, for example, one or more resins and/or pigments. Generally, the electrocoat coating composition may be categorized as a cathodic electrocoat coating composition.

After immersing, a second potential of electric current is applied between the magnesium-based substrate 12 and the counter electrode to deposit the electrocoat coating composition onto the magnesium-based substrate 12. The second potential of electric current is greater than the first potential of electric current. In one example, the first potential of electric current may be less than or equal to approximately one fourth of the second potential of electric current.

The second potential of electric current applied between the magnesium-based substrate 12 and the counter electrode may be from approximately 220 to 240 V. In general, the second potential may be selected according to the desired film thickness of the coating deposited on the magnesium-based substrate 12. Therefore, the second potential of electric current may be referred to as a deposition potential.

In particular, after the magnesium-based substrate 12 has been immersed in the electrocoat coating composition, the applied second potential of electric current may increase from the first potential, e.g., less than or equal to approximately 40 V, to approximately 220 to 240 V. The magnesium-based substrate 12 may be a cathode and electrically attract the electrocoat coating composition. More specifically, the applied second potential of from approximately 220 to 240 V causes the electrocoat coating material to adhere to the magnesium-based substrate 12. That is, since materials with opposite electrical charges attract, the negatively-charged magnesium-based substrate 12 attracts the positively-charged electrocoat coating composition, which then deposits onto the magnesium-based substrate 12 to form a film having a desired thickness. Once the electrocoat coating composition reaches the desired thickness, attraction diminishes and deposition is complete.

The method also includes curing the electrocoat coating composition to form a cured film 14 and thereby coat the magnesium-based substrate 12. That is, after the magnesium-based substrate 12 exits the electrocoat coating composition, the magnesium-based substrate 12 may be heated, e.g., baked, to cross-link the polymers and allow for off-gassing of the electrocoat coating composition. A cure temperature may be selected according to the formulation of the electrocoat coating composition and desired manufacturing time and costs.

It is to be appreciated that the method may also include rinsing the magnesium-based substrate 12 before curing. That is, the magnesium-based substrate 12 may be rinsed to remove any undeposited electrocoat coating composition from the magnesium-based substrate 12 before the electrocoat coating composition is cured. More specifically, once the electrocoat coating composition deposits onto the magnesium-based substrate 12, deposition gradually slows due to an insulating effect of the electrocoat coating composition. As the magnesium-based substrate 12 exits the electrocoat coating composition, solids may cling to the magnesium-based substrate 12 and require rinsing to provide an aesthetic appearance on the magnesium-based substrate 12. Such rinsed solids may then be returned to the electrocoat coating composition.

In another embodiment, a method of coating a magnesium-based substrate 12 includes applying a first potential of electric current of approximately 5 V to the magnesium-based substrate 12 and, after applying the first potential, immersing the magnesium-based substrate 12 in the electrocoat coating composition. After immersing, a second potential of electric current of from approximately 220 to 240 V is applied between the magnesium-based substrate 12 and the counter electrode to deposit the electrocoat coating composition onto the magnesium-based substrate 12. That is, the magnesium-based substrate 12 may be a cathode and attract the positively-charged electrocoat coating composition for deposition onto the magnesium-based substrate 12. The method also includes curing the electrocoat coating composition to form the cured film 14 and thereby coat the magnesium-based substrate 12.

Referring now to the drawing, an electrocoat coating system is shown generally at 10 in FIG. 1. The electrocoat coating system 10 includes the magnesium-based substrate 12. In one example, the magnesium-based substrate 12 may be a vehicle body. That is, the magnesium-based substrate 12 may be a vehicle body-in-white that does not yet include trim and powertrain components. Alternatively, the magnesium-based substrate 12 may be a component of a vehicle, e.g., a body panel, a door panel, a decklid, or a roof.

The electrocoat coating system 10 also includes the cured film 14 disposed on the magnesium-based substrate 12 and formed from the electrocoat coating composition. The electrocoat coating composition may be cathodically depositable. Stated differently, the electrocoat coating composition may be positively-charged so as to deposit on the negatively-charged magnesium-based substrate 12, i.e., the cathode. Further, the cured film 14 formed from the electrocoat coating composition may have a film thickness of from 0.05 to 2 mils. As used herein, 1 mil is equivalent to 0.0254 millimeter.

The magnesium-based substrate 12 exhibits a negative charge from the applied first potential of electric current of less than or equal to approximately 40 V prior to contact with the electrocoat coating composition. Further, the magnesium-based substrate 12 is substantially free from magnesium dissolution when in contact with the electrocoat coating composition. Without intending to be limited by theory, since the equilibrium potential of magnesium is about −2.4 V NHE (normal hydrogen electrode), and an open circuit potential of the counter electrode in the electrocoat coating composition is generally not more positive than 1 V NHE, the first potential between the magnesium-based substrate 12 and the counter electrode is sufficient to minimize, if not substantially prevent, any anodic magnesium dissolution of the magnesium-based substrate 12 in the electrocoat coating composition. Further, the first potential is sufficient to minimize, if not substantially suppress, any galvanic effect between the magnesium-based substrate 12 and other steel or aluminum alloy components. Therefore, the magnesium-based substrate 12 of the electrocoat coating system 10 is not galvanic corroded due to the application of the first potential. Additionally, the cured film 14 is not anodic with respect to the magnesium-based substrate 12 and is not sacrificially consumed by electrochemical corrosion in humid environments.

The methods and system of the present invention minimize magnesium dissolution of magnesium-based substrates 12 during electrocoating. Therefore, the methods also minimize fouling and replacement of electrocoat coating compositions during manufacturing. The methods are cost effective and compatible with conventional electrodeposition equipment. Finally, the methods and system provide an excellent cured film on a magnesium-based substrate 12 to protect the substrate 12 from oxidation and other corrosive reactions in humid environments.

While the best modes for carrying out the invention have been described in detail, those familiar with the art to which this invention relates will recognize various alternative designs and embodiments for practicing the invention within the scope of the appended claims.

The invention claimed is:

1. A method of coating a magnesium-based substrate, the method comprising the steps of:

applying a first potential of electric current to the magnesium-based substrate to thereby negatively charge and protect the magnesium-based substrate against magnesium dissolution;

after applying, immersing the negatively charged magnesium-based substrate in an electrocoat coating composition;

after immersing, applying a second potential of electric current between the magnesium-based substrate and a counter electrode to deposit a film from the electrocoat coating composition onto the magnesium-based substrate;

wherein the second potential of electric current is greater than the first potential of electric current; and curing the film to form a cured film disposed on the magnesium-based substrate to thereby coat the magnesium-based substrate with the cured film;

wherein applying the first potential of electric current controls magnesium dissolution of the magnesium-based substrate in the electrocoat coating composition before the cured film is formed and disposed on the magnesium-based substrate.

2. The method of claim 1, wherein the first potential of electric current is less than or equal to approximately one fourth of the second potential of electric current.

3. The method of claim 2, wherein the first potential of electric current is less than or equal to approximately 40 V.

4. The method of claim 1, wherein the first potential is less than or equal to approximately 10 V.

5. The method of claim 1, wherein the second potential of electric current applied between the magnesium-based substrate and the counter electrode is from approximately 220 to 240 V.

6. The method of claim 1, wherein the magnesium-based substrate is a cathode.

7. The method of claim 1, further comprising pretreating the magnesium-based substrate before applying the first potential of electric current.

8. The method of claim 1, further comprising rinsing the magnesium-based substrate before curing.

9. A method of coating a magnesium-based substrate, the method comprising the steps of:

applying a first potential of electric current of approximately 5 V to the magnesium-based substrate to thereby negatively charge and protect the magnesium-based substrate against magnesium dissolution;

after applying, immersing the negatively charged magnesium-based substrate in an electrocoat coating composition;

after immersing, applying a second potential of electric current of from approximately 220 to 240 V between the magnesium-based substrate and a counter electrode to deposit a film from the electrocoat coating composition onto the magnesium-based substrate; and curing the film to form a cured film disposed on the magnesium-based substrate to thereby coat the magnesium-based substrate with the cured film;

wherein applying the first potential of electric current controls magnesium dissolution of the magnesium-based substrate in the electrocoat coating composition before the cured film is formed and disposed on the magnesium-based substrate.

10. The method of claim 9, wherein the magnesium-based substrate is a cathode.

* * * * *